United States Patent [19]

Sayama et al.

[11] 4,448,018

[45] May 15, 1984

[54] METHOD FOR ADDING WATER TO A HEAT EXCHANGING SYSTEM

[75] Inventors: Norio Sayama; Hiromi Nakamura, both of Chiba, Japan

[73] Assignee: Mitsubishi Gas Chemical Company, Inc., Tokyo, Japan

[21] Appl. No.: 324,096

[22] Filed: Nov. 23, 1981

[30] Foreign Application Priority Data

Nov. 25, 1980 [JP] Japan ..... 55-165719

[51] Int. Cl.[3] ..... F02C 3/30; F02C 7/143

[52] U.S. Cl. ..... 60/39.05; 60/39.53; 60/39.511; 60/728

[58] Field of Search ..... 60/39.05, 39.465, 39.53, 60/39.55, 39.58, 39.59, 728, 39.511

[56] References Cited

U.S. PATENT DOCUMENTS 2,186,706 1/1940 Martinka ..... 60/39.53

2,678,532 5/1954 Millen ..... 60/39.05

FOREIGN PATENT DOCUMENTS 2005656 8/1971 Fed. Rep. of Germany .

286978 3/1953 Switzerland ..... 60/39.53

*Primary Examiner*—Louis J. Casaregola

*Attorney, Agent, or Firm*—Cushman, Darby & Cushman

[57] ABSTRACT

A method and system for operating a regenerative gas turbine in which a compressed gaseous medium is saturated with steam from untreated water having impurities in a first contact chamber and then supplied to a second chamber where the mixture is washed with pure water to remove impurities. The resulting mixture is mixed with fuel and combusted to supply gas to the turbine. Exhaust gas from the turbine is supplied to two serially connected regenerators which transfer heat to the recirculating untreated and pure water.

8 Claims, 2 Drawing Figures

METHOD FOR ADDING WATER TO A HEAT EXCHANGING SYSTEM

FIELD OF THE INVENTION

The present invention relates to an improvement of a novel method of heat recovery or novel heat exchanging system for exhaust gas of a heat engine wherein heat recovery is carried out by way of a mixture which is obtained by adding liquid phase water to compressed air or gas including air as the main part thereof which is used as combustion supporting gas or working medium gas or the like, or compressed gaseous fuel, if it is required, in case that such gaseous fuel is used as fuel (this is referred to hereafter as "compressed air"), or by contacting the former with the latter, which is disclosed by Japanese Patent Ser. No. 78808/80 et al. More particularly, the present invention relates to a method for adding water to the heat exchanging system including the above-mentioned constitution characterized in that the addition of water or contact of water is conducted by means of two or more contacting chambers under pressure positioned in series, water including non-volatile substances or materials is used in the first or intermediate contacting chambers, and pure water without obstructing the subsequent or following procedures is used in the last contacting chamber.

In the heat exchanging system wherein heat recovery is carried out by way of a mixture which is obtained by adding liquid phase water to compressed air (this system is referred to hereafter as "a water injection cycle"), heat recovery is conducted by way of the mixture in which transformation of water from liquid phase to gas phase is performed in the presence of air or gas including air as the main part thereof or under co-existence of air and compressed gaseous fuel, if it is required, in case such gaseous fuel is used as fuel. This results in great improvement in effectiveness of heat recovery, decrease in the amount of compressed gas to be required, and high temperature of the work producing cycle, which in turn brings great improvement in thermal efficiency and output ratio with various advantages. Since, the amount of water to be needed is generally from several to ten times as much as that of fuel (for example, in case the work output is 100,000 KW/h, the amount of water needed is 2,000–3,000 tons/day), and all the water is vaporized, non-volatile substances melting in the water are educed or extracted therefrom so that they won't obstruct the conduits or assemblies in the regenerators R1, R2, combustion chamber CC, expansion turbine ET or the like. Therefore, it is preferable that water for such purpose must be high grade water such as pure water, boiler water or the like. However, to produce such a large amount of pure water it is necessary to construct a large scale pure water producing plant, this requirement is a big disadvantage of the conventional method.

SUMMARY OF THE INVENTION

The object of the present invention is to provide a novel and improved method for adding water to the heat exchanging system wherein heat recovery is carried out by mixture of air/steam, air/steam/water or gaseous fuel/steam.

A further object of the present invention is to provide a novel method wherein water including non-volatile substances such as industrial water, river water, sea water or the like can be used as water for contact or addition in the first step of contact or addition.

The present invention accomplishes the above-mentioned objects by using a method for adding water to the heat exchanging system wherein heat recovery is carried out by way of a mixture which is obtained by adding liquid phase water to compressed air or gas including air as the main part thereof which is used as combustion supporting gas, working medium gas or the like, or compressed gaseous fuel, if it is required, in the case that such gaseous fuel is used as fuel, or by contacting the former with the latter, or heat recovery is carried out while adding the former to the latter or contacting the former with the latter, said method being characterized in that addition of water or contact of water is conducted by means of two or more contacting chambers under pressure located in series, water including non-volatile substances is used in the first and intermediate contacting chambers, and pure water which will cause no obstruction in the following procedures is used in the last contacting chamber.

DESCRIPTION OF THE PREFERRED EMBODIMENT

In the present invention, examples of water including non-volatile substances are industrial water, river water, sea water or the like, and examples of pure water which will not cause obstructions in the following procedures are distilled water, boiler water or the like.

Figure 1:
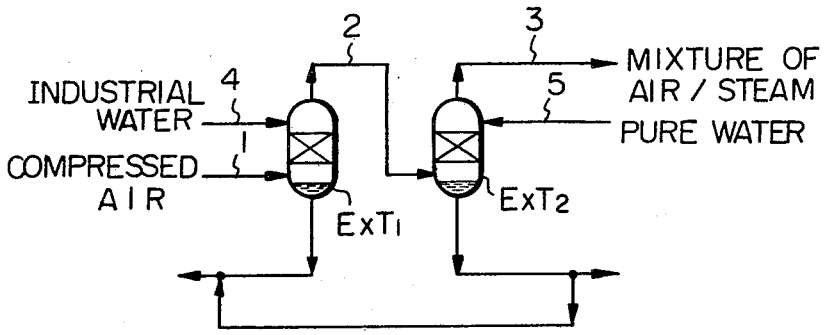
FIG. 1 is a schematic block diagram of a preferred embodiment in accordance with the present invention.

In FIG. 1, the first and the second contacting chambers EXT1 and EXT2 are located in series. Compressed air is introduced into the first contacting chamber EXT1 through an absorbing conduit 1. Water including non-volatile substances such as sodium, calcium or the like is introduced into the first contacting chamber EXT1 through conduit 4 and falls in cascade fashion therewithin or is injected therewithin. In the first contacting chamber EXT1 the compressed gas is contacted with the water including non-volatile substances so that the partial pressure of steam is increased at a predetermined level and then is discharged therefrom through a conduit 2. In this connection, water may be preheated by means of intermediate compressed gas or intermediate compressed gaseous fuel and/or exhaust gas through a regenerator. Meanwhile water may circulate in each contacting chamber or return from the second contacting chamber EXT2 to the first contacting chamber EXT1, or water accumulated within the contacting chambe may be introduced either into the first contacting chamber EXT1 in case of contaminated water or into the second contacting chamber EXT2 in case of pure water. The number of contacting chambers is selected so that the pressure loss isn't so large. By this procedure, the percentage of humidity in the compressed air is increased. But the compressed air includes a little amount of non-volatile substances in mist which is a one big disadvantage of the conventional method. In this position, partial pressure of steam is less than that of compressed air including pure water due to the presence of non-volatile substances.

The above-mentioned non-volatile substances must be removed from the compressed air so as not to obstruct the following procedures. Thus, the necessary amount of water including no obstructing substances is introduced into the second contacting chamber EXT2 through a conduit 5 and falls in cascade fashion or is injected so that the water is contacted with the mixture of compressed air and water including non-volatile substances which results in removal of the non-volatile substances and increases the partial pressure of steam within the mixture. This water may be preheated by the intermediate compressed air, intermediate compressed gaseous fuel and/or exhaust gas through intermediate cooler IC or the regenerator R1, R2. In order to reduce the concentration of non-volatile substances within the water a part of or the whole of the water accumulated in the second contacting chamber EXT2 is introduced into the first contacting chamber EXT1 or it circulates through bypass conduit into the second contacting chamber EXT2.

Figure 2:
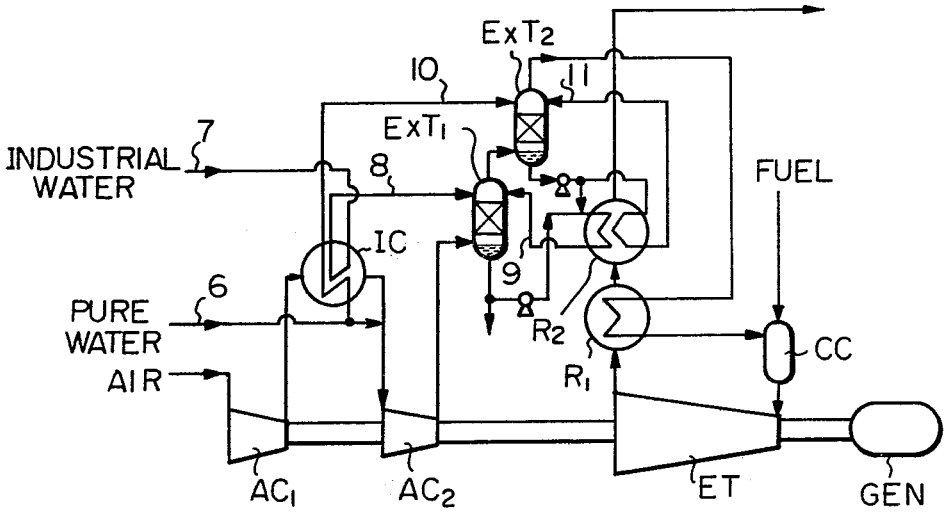
FIG. 2 is a schematic block diagram of a heat exchanging system including the preferred embodiment according to the present invention described in the FIG. 1.

FIG. 2 is a schematic block diagram of a heat exchanging system including the preferred embodiment according to the present invention described in FIG. 1. In FIG. 2, the conduits 4 and 5 in FIG. 1 correspond to the combination of contuits 8 and 9, and 10 and 11, respectively.

Untreated water containing impurities is supplied to the upper part of contacting chamber $E_XT_1$ via conduit 8 which passes through intermittent cooler IC which transfers heat thereto. Pure water likewise passes to the upper part of a second contact chamber $E_XT_2$ via line 6, intermittent cooler IC and line 10. A multi-stage air compressor including first part $AC_1$ and $AC_2$ is driven by turbine $E_2$ to produce a compressed gaseous medium which is introduced into first contacting chamber $E_XT_1$. An intermittent compressed medium passes through intermittent cooler IC so that waste heat therein is transferred to the untreated water and to the pure water.

Untreated water which was accumulated in the bottom of first contacting chamber $E_XT_1$ is recirculated via line 9 through a regenerator $R_2$. A valve is provided in line 9 for removing waste water from the system.

Pure water in the bottom of second contacting chamber $E_XT_2$ is similarly recirculated via line 11 through the regenerator $R_2$. Some of the pure water is supplied to the line 9 and hence to the upper part of first contacting chamber $E_XT_1$. A valve is likewise provided in line 11 for removing pure water when it becomes too dirty. The mixture of gaseous medium and steam washed by the pure water in second contacting chamber $E_XT_2$ is supplied by a second regenerator $R_1$ to a conventional combustion chamber which also receives fuel. The burned discharge of the combustion chamber is conventionally supplied to the turbine which drives a generator as well as the air compressors. The exhaust gas from the turbine is supplied to the two serially connected regenerators $R_1$ and $R_2$ and, hence, discharged to the atmosphere.

As described above, the present invention provides great improvement in the provision of water to the combined cycle and therefore, the present invention has significant industrial value.

What is claimed is:

1. A method for operating a regenerative gas turbine cycle to recover heat from the exhaust gas of a turbine comprising the steps of:

compressing a gaseous medium to a predetermined pressure;

saturating the compressed gaseous medium with steam from untreated water containing impurities to form a mixture of said gaseous medium and steam;

washing said mixture with pure water to remove said impurities;

transferring heat from said exhaust gas to said mixture;

mixing the heated mixture with fuel and combusting to drive said turbine; and discharging the exhaust gas after the heat transfer.

2. A method as in claim 1, wherein said step of compressing includes compressing in at least two steps producing an intermediate compressed medium having waste heat and including the step of transferring said waste heat to said untreated water before saturating and to said pure water before washing.

3. A method as in claim 1, including the further step of adding the used pure water to said untreated water after washing.

4. A method as in claim 1, wherein said step of saturating includes the steps of introducing said untreated water into a first contact chamber so that the introduced water falls to the bottom thereof and recirculating water in the bottom of said chamber to region of introduction and including the further step of transferring heat from said exhaust to the recirculating water.

5. A regenerative gas turbine system comprising:

a gas turbine for the production of power;

a compressor driven by the gas turbine for compressing a gaseous medium to a predetermined pressure;

means for supplying said medium to said compressor;

a first contacting chamber for saturating a compressed gaseous medium with steam from untreated water containing impurities to form a mixture of steam and said compressed medium;

means for supplying said medium to said first chamber;

means for supplying said untreated water to the upper portion of said first chamber;

at least two regenerators mounted in series for receiving exhaust gas from the gas turbine;

means for recirculating untreated water accumulated in the bottom of the first chamber through one of said regenerators to the top thereof so as to transfer heat to the recirculating water;

a second contacting chamber for washing the mixture with pure water to remove said impurities;

means for supplying said pure water to the upper portion of said second chamber;

means for supplying used pure water accumulated in the bottom of said second chamber to the upper portion of said first chamber;

a combustion chamber;

means for supplying the washed mixture to said combustion chamber;

means for supplying fuel to said combustion chamber for combustion to produce a burned gas discharge;

means for supplying said discharge to said turbine; and means for supplying the exhaust gas from said turbine to said regenerators.

6. A system as in claim 5, wherein said recirculating means includes means for discharging said untreated water from the system when it is too dirty.

7. A system as in claim 5, wherein said compressor is a two stage compressor producing an intermediate compressed medium having waste heat therein and including heat exchange means for transferring said waste heat to said medium and said untreated water before introduction into said first chamber.

8. A system as in claim 5, further including second means for recirculating said pure water from the top to the bottom of said second chamber through one of said regenerators to transfer heat to the recirculating pure water.

* * * * *